US005753085A

United States Patent [19]

FitzPatrick

[11] Patent Number: 5,753,085

[45] Date of Patent: May 19, 1998

[54] TEXTILE SUBSTRATE FOR A LONG NIP PRESS BELT

[75] Inventor: Keith FitzPatrick, Dieren, Netherlands

[73] Assignee: Albany International Corp., Albany, N.Y.

[21] Appl. No.: 661,650

[22] Filed: Jun. 11, 1996

[51] Int. Cl.[6] ..... D21F 3/02

[52] U.S. Cl. ..... 162/358.4; 162/901; 198/847

[58] Field of Search ..... 162/358.4, 902, 162/901, 900; 198/847

[56] References Cited

U.S. PATENT DOCUMENTS

| | | | |
|---|---|---|---|
| 4,946,731 | 8/1990 | Dutt | 162/901 |
| 5,097,872 | 3/1992 | Laine et al. | 162/902 |
| 5,132,141 | 7/1992 | Schun | 162/901 |
| 5,167,771 | 12/1992 | Sayers et al. | 162/901 |
| 5,238,537 | 8/1993 | Dutt | 162/358.4 |
| 5,361,808 | 11/1994 | Bowen, Jr. | 139/383 A |
| 5,364,692 | 11/1994 | Bowen, Jr. et al. | 139/383 A |
| 5,449,548 | 9/1995 | Bowen, Jr. | 139/383 A |
| 5,495,935 | 3/1996 | Zabron et al. | 198/847 |

*Primary Examiner*—Karen M. Hastings
*Attorney, Agent, or Firm*—Kane, Dalsimer, Sullivan, Kurucz, Levy, Eisele and Richard, LLP.

[57] ABSTRACT

A long nip press belt for a papermaking machine has a textile substrate impregnated and coated on at least one side with a polymeric resin material. The polymeric resin material is ground and buffed after being cured to provide the belt with a smooth surface and a uniform thickness. The textile substrate includes textile components (monofilaments, continuous fine filaments or staple fibers) having non-circular cross sections with a plurality of lobes. Such cross sections provide the textile components with a greater surface area than would be provided by components of equal denier having circular cross sections. As a consequence, the mechanical interlock and chemical bond or adhesion of the polymeric resin coating to the textile substrate are strengthened. In addition, the textile components having non-circular cross-sections with a plurality of lobes reduce the permeability of the textile substrate, so that polymeric resin material applied to one side may be prevented from flowing through to the other side.

10 Claims, 5 Drawing Sheets

TEXTILE SUBSTRATE FOR A LONG NIP PRESS BELT

BACKGROUND OF THE INVENTION

1. Field of the Invention

The present invention relates to mechanisms for extracting water from a web of material, and more particularly from a fibrous web being processed into a paper product on a papermaking machine. Specifically, the present invention is an impermeable belt designed for use on a long nip press on a papermaking machine.

2. Description of the Prior Art

During the papermaking process, a fibrous web is formed on a forming wire by depositing a fibrous slurry thereon. A large amount of water is drained from the slurry during this process, after which the newly formed web proceeds to a press section. The press section includes a series of press nips, in which the fibrous web is subjected to compressive forces designed to remove water therefrom. The web finally proceeds to a drying section which includes heated dryer drums around which the web is directed. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial especially when a large amount of water needs to be removed from the web.

Traditionally, press sections have included a series of nips formed by pairs of adjacent cylindrical press rolls. In recent years, the use of long press nips has been found to be advantageous over the use of nips formed by pairs of adjacent press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip is formed which can be five to ten times longer in the machine direction than one formed between two press rolls. This increases the so-called dwell time of the fibrous web in the long nip while maintaining the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

The monofilaments used to weave the base fabric of the belt shown in U.S. Pat. No. 5,238,537 are of circular cross section. In such a case, the monofilaments may be thought of as elongated cylinders. It is well-known that a circular cross section provides the monofilament with a minimum surface area. As a consequence, the strength of the mechanical interlock, and possible chemical bond and adhesion, between the cured impregnating material and base fabric, is minimized where the yarns of the base fabric are of circular cross section. Delamination of the coating from the base fabric is a possible consequence.

The present invention provides a solution to this problem by increasing the surface area and by changing the cross-sectional configurations of the yarns making up the base fabric in order to strengthen the connection between the cured impregnating material and the base fabric.

SUMMARY OF THE INVENTION

Accordingly, the present invention is a long nip press belt for a papermaking machine, wherein the belt comprises a textile substrate impregnated and coated on at least one side thereof with a polymeric resin material. The polymeric resin material is ground and buffed after being cured to provide the belt with a smooth surface and a uniform thickness. The textile substrate includes textile components having non-circular cross sections with a plurality of lobes. The textile components having such cross sections may be monofilaments, continuous fine filaments or staple fibers. The monofilaments may be used to provide a textile substrate in the form of a woven fabric. Continuous fine filaments may be used to provide a textile substrate in the form of a non-woven matrix. Finally, staple fibers may be used in the form of a non-woven batt as the textile substrate, or, in the same form, may be needled into a fabric woven from monofilament yarns, perhaps themselves having non-circular cross sections with a plurality of lobes, for use as a textile substrate.

The present invention will now be described in more complete detail with frequent reference being made to the figures, which are listed and identified as follows.

DETAILED DESCRIPTION OF THE PREFERRED EMBODIMENT

Figure 1:
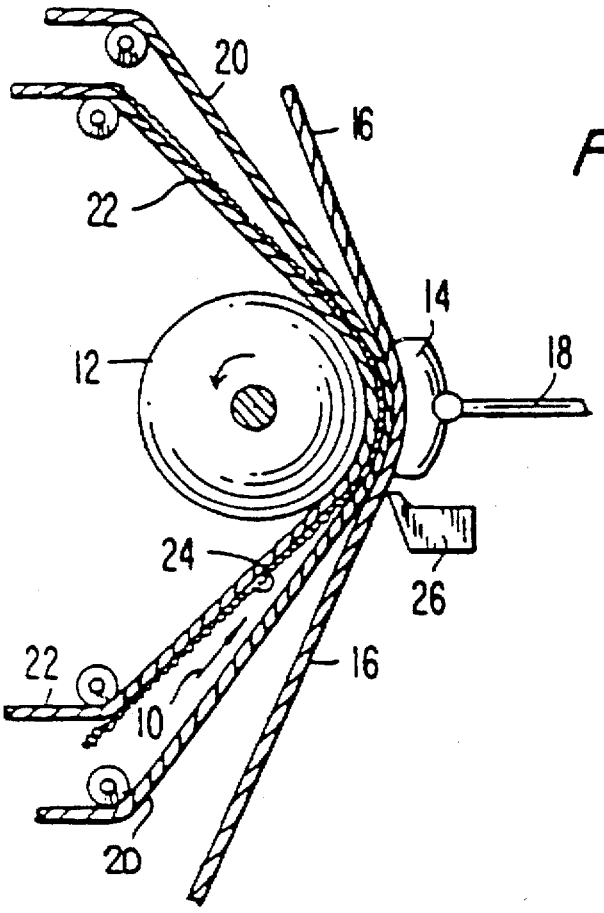
FIG. 1 is a side elevational view of a long press nip for which the belt of the present invention is intended.
Figure 2:
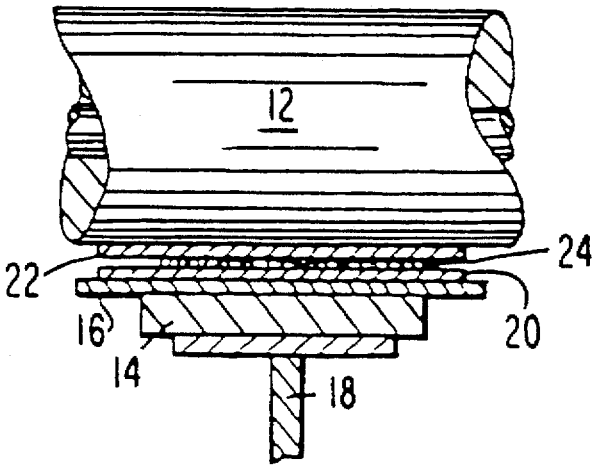
FIG. 2 is a partially sectioned front view of the press nip shown in FIG. 1.

A long nip press for dewatering a fibrous web being processed into a paper product on a paper machine is shown in FIGS. 1 and 2. The press nip 10 is defined by a smooth cylindrical press roll 12, an arcuate pressure shoe 14, and a belt 16 arranged such that it bears against the surface of the cylindrical press roll 12. The arcuate pressure shoe 14 has about the same radius of curvature as the cylindrical press roll 12. The distance between the cylindrical press roll 12 and the arcuate pressure shoe 14 may be adjusted by means of conventional hydraulic or mechanical apparatus, which is not shown, connected to rod 18 pivotally secured to arcuate pressure shoe 14. The rod 18 may also be actuated to apply the desired pressure to the arcuate pressure shoe 14. It will be appreciated that the cylindrical press roll 12 and the arcuate pressure shoe 14 described above and shown in FIGS. 1 and 2 are conventional in the art.

A first papermaker's wet press fabric 20, a second papermaker's wet press fabric 22, and a fibrous web 24 being processed into a paper sheet are included in FIGS. 1 and 2. The motions of the belt 16, the first papermaker's wet press fabric 20, the second papermaker's wet press fabric 22, and the fibrous web 24 through the press nip 10 are upward in FIG. 1. Lubricating means 26 in FIG. 1 dispenses oil onto the side of belt 16 facing arcuate pressure shoe 14 to facilitate its sliding motion thereagainst.

The present invention concerns belt 16 which comprises a textile substrate, at least one side of which is coated with a polymeric resin material. That side of belt 16 which faces arcuate pressure shoe 14 must be coated; the other side of belt 16, that is, the side opposite to that facing arcuate pressure shoe 14 may be coated where desired, such as may be the case when that side of the belt 16 is to be provided with grooves or other water-conveying or water-holding means.

The coating of polymeric resin material on the side of belt 16 facing arcuate pressure shoe 14 protects the textile substrate from the sliding contact across the lubricated arcuate pressure shoe 14 and from the wear by abrasion that would otherwise result. The polymeric resin material also impregnates the textile substrate and renders the belt 16 impervious to oil and water. The polymeric resin material may be polyurethane, and preferably a 100% solids composition thereof to avoid the formation of bubbles during the curing process through which the polymeric resin material proceeds following its application onto the textile substrate. After curing, the polymeric resin material may be ground and buffed to provide the belt 16 with a smooth surface and a uniform thickness. Where both sides of the textile substrate are coated with a polymeric resin material, the cured coating on both sides may be ground and buffed to provide belt 16 with smooth surfaces and a uniform thickness, and the side opposite to that which will face the arcuate pressure shoe 14 may be provided with a plurality of grooves or similar indentations for the temporary storage of water pressed from fibrous web 24 in the press nip 10.

The present invention primarily concerns the textile substrate of the belt 16. The textile substrate may be constructed as a woven fabric of a single- or multi-layer weave, a non-woven matrix of continuous filaments, a batt of staple fibers, or any combination thereof.

The primary function of the textile substrate is to provide belt 16 with dimensional stability. Further, it is an essential requirement of the textile substrate to provide sufficient sites onto which the polymeric resin material to be applied thereto may be attached by both chemical and mechanical means. It may also be a requirement of the textile substrate to prevent the passage of the polymeric resin material therethrough to the opposite side of the substrate, so that the opposite side may remain free of coating, or so that sufficient sites may remain available on that side for a coating, perhaps of a different polymeric resin material.

In the present invention, monofilaments, continuous fine filaments and/or staple fibers having a non-circular cross section would be used in the construction of the textile substrate. Preferably, the non-circular cross sections would be profiled or multi-lobed.

Filaments and fibers of profiled or multi-lobed cross section have greater surface areas than those of circular cross section having the same denier. In the present invention, the greater surface area of the filaments and/or fibers is available to increase the chemical bonding or adhesion of the coating material thereto. The profiled or multi-lobed cross sections also restrict the amount of coating material able to flow through the textile substrate, and improve the mechanical interlock between the cured coating material and the textile substrate.

More specifically, filaments and fibers of profiled or multi-lobed cross section lower the permeability of the textile substrate to prevent or control the passage of polymeric resin material therethrough to its opposite side, so that the opposite side may remain free of coating, or so that sufficient sites may remain available on the opposite side for a coating, perhaps of a different polymeric resin material. The subject filaments and fibers therefore provide an additional control on the permeability of the textile substrate, as well as giving the substrate a greater surface-area-to-weight ratio than that which could be obtained using yarns of circular cross section.

In short, then, the present invention is a long nip press belt comprising a textile substrate impregnated and coated on at least one side thereof with a polymeric resin material, the polymeric resin material being ground and buffed after being cured to provide the long nip press belt with a smooth surface and a uniform thickness. The textile substrate of the long nip press belt comprises monofilaments, continuous fine filaments or staple fibers having non-circular (profiled or multi-lobed) cross-sections.

Where the textile substrate comprises monofilaments, it may be interwoven from machine (longitudinal) direction and cross-machine (transverse) direction monofilament yarns in a single- or multi-layer weave. Continuous fine filaments may be used to form a non-woven matrix for use as the textile substrate. The staple fibers, finally, may be used in the form of a batt as the textile substrate. The batt may be needled into a base fabric, or used separately, to provide the textile substrate.

Figure 3:
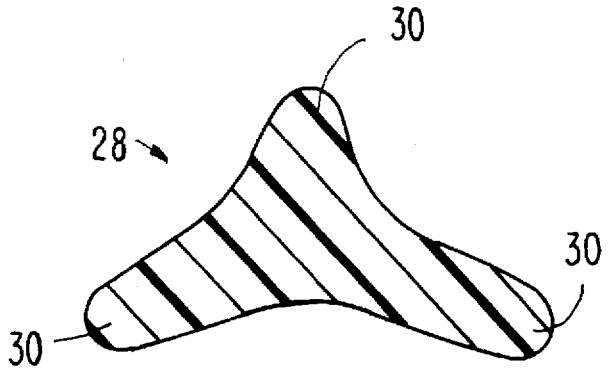
FIG. 3 is a cross-sectional view of a monofilament, continuous fine filament or staple fiber used in the textile substrates of the long nip press belts of the present invention.

FIG. 3 is a cross-sectional view of a monofilament, continuous fine filament or staple fiber 28 used in producing the textile substrates in accordance with the present invention. Monofilament, continuous fine filament or staple fiber 28 may be extruded from a polymeric resin material, such as polyester or polyamide. The cross-sectional view presented in FIG. 3 indicates the presence of three lobes 30, which give the filament or fiber 30 a greater surface area compared to one of equal denier having a circular cross section.

Figure 4:
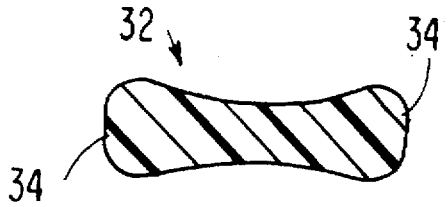
FIG. 4 is a cross-sectional view of an alternate embodiment of the monofilament, continuous fine filament or staple fiber.

FIG. 4 is a cross-sectional view of another embodiment of a monofilament, continuous fine filament or staple fiber 32 used in producing the textile substrates. The cross-sectional view presented in FIG. 4 indicates the presence of two lobes 34 on a substantially dog-bone-shaped cross section.

In general, monofilaments, continuous fine filaments or staple fibers having cross sections with a plurality (greater than one) of lobes may be used in producing the textile substrates for the long nip press belts of the present invention.

Figure 5:
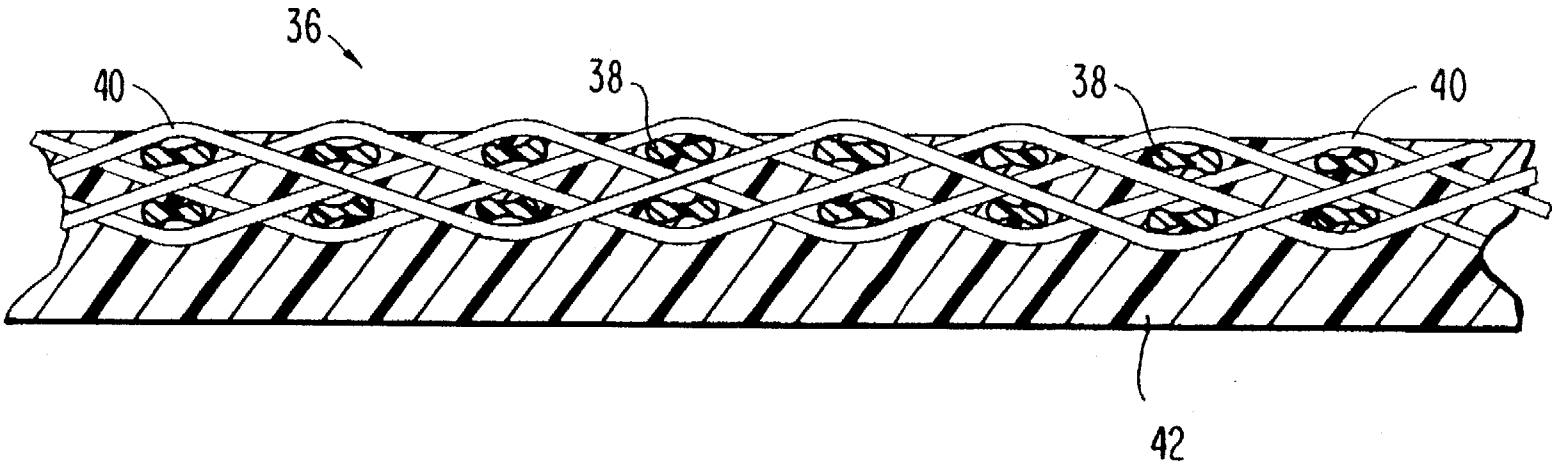
FIG. 5 is a cross-sectional view of a long nip press belt of the present invention.

FIG. 5 is a cross-sectional view of a long nip press belt 36 taken in the longitudinal direction and showing transverse yarns 38 in cross section. Transverse yarns 38 are monofilaments having the cross-sectional shape shown in FIG. 4. Longitudinal yarns 40 may have the same cross-sectional shape as transverse yarns 38, or may have a circular or some other shaped cross section. Transverse yarns 38 are interwoven with longitudinal yarns 40 in a multi-layer weave. Knuckles formed when longitudinal yarns 40 weave over transverse yarns 38 may be visible on one surface of the belt 36. The other surface of the belt is formed by a polymeric resin coating 42.

Figure 6:
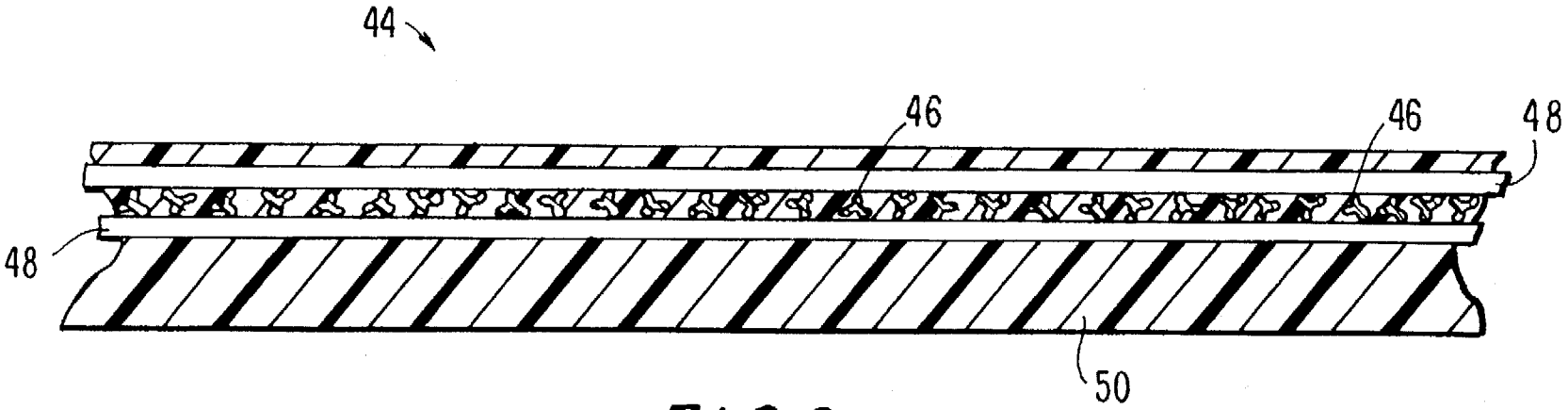
FIG. 6 is a cross-sectional view of an alternate embodiment of the long nip press belt.

FIG. 6 is a cross-sectional view of an alternate embodiment of the long nip press belt 44. The cross-sectional view is also taken in the longitudinal direction and shows transverse continuous fine filaments 46 of the variety shown in FIG. 3 in cross section. Longitudinal continuous fine filaments 48 may have the same cross-sectional shape as transverse continuous fine filaments 46, or may have a circular or some other shaped cross section. Transverse continuous fine filaments 46 and longitudinal continuous fine filaments 48 are not interwoven with one another, but form a non-woven matrix. A polymeric resin coating 50 is provided on both sides of long nip press belt 44.

Figure 7:
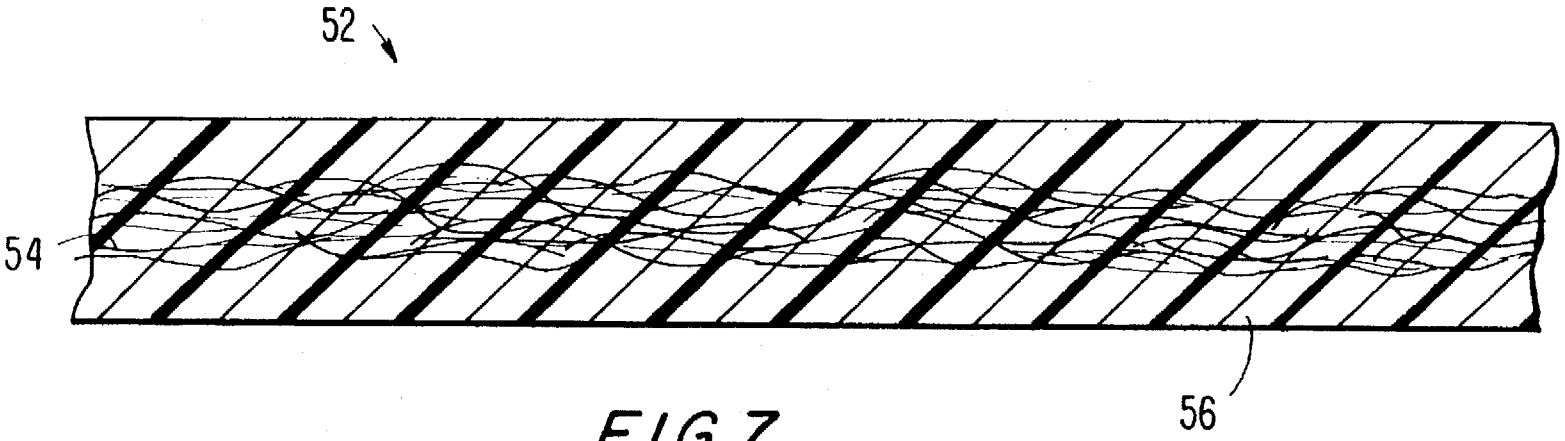
FIG. 7 is a cross-sectional view of still another embodiment of the long nip press belt.

FIG. 7 is a cross-sectional view of yet another embodiment of the long nip press belt 52. The cross-sectional view is also taken in the longitudinal direction, although one taken in another direction would have the same appearance. The textile substrate of the belt 52 is a batt 54 of staple fibers. The staple fibers have cross sections like those shown in FIGS. 3 and 4, or may have other multi-lobed cross sections. A polymeric resin coating 56 is provided on both sides of long nip press belt 52.

In still another alternate embodiment a batt of staple fibers having the cross sections characteristic of the present invention may be needled into a woven textile substrate like that shown in FIG. 5, and the needled woven textile substrate coated with a polymeric resin material to produce a long nip press belt.

It will be recognized that modifications to the above would be obvious to anyone of ordinary skill in the art without departing from the scope of the claims appended herein below.

What is claimed is:

1. A long nip endless impermeable press belt for a papermaking machine, said belt comprising a textile substrate impregnated and coated on at least one side thereof with a polymeric resin material, said polymeric resin material being ground and buffed after being cured to provide said belt with a smooth surface and a uniform thickness, wherein said textile substrate includes textile components having non-circular cross sections with a plurality of lobes, said textile components being selected from the group consisting of monofilaments, continuous fine filaments and staple fibers, said textile components structured and arranged so as to prevent passage of polymeric resin through said textile substrate.

2. A long nip press belt as claimed in claim 1 wherein said textile substrate is a fabric woven from longitudinal and transverse monofilament yarns, said monofilament yarns being said textile components, at least some of said monofilament yarns having said non-circular cross sections with a plurality of lobes.

3. A long nip press belt as claimed in claim 1 wherein said fabric is woven in a single-layer weave.

4. A long nip press belt as claimed in claim 1 wherein said fabric is woven in a multi-layer weave.

5. A long nip press belt as claimed in claim 1 wherein said textile substrate is a non-woven matrix formed from longitudinal and transverse continuous fine filaments, said continuous fine filaments being said textile components, at least some of said continuous fine filaments having said non-circular cross sections with a plurality of lobes.

6. A long nip press belt as claimed in claim 1 wherein said textile substrate is a non-woven batt of staple fibers, said staple fibers being textile components, at least some of said staple fibers having said non-circular cross sections with a plurality of lobes.

7. A long nip press belt as claimed in claim 1 wherein said textile substrate is a fabric woven from longitudinal and transverse yarns, said fabric being needled with a non-woven batt of staple fibers, said staple fibers being said textile components, at least some of said staple fibers having said non-circular cross sections with a plurality of lobes.

8. A long nip press belt as claimed in claim 7 wherein said fabric is woven in a single-layer weave.

9. A long nip press belt as claimed in claim 7 wherein said fabric is woven in a multi-layer weave.

10. A long nip press belt as claimed in claim 7 wherein at least some of said longitudinal and transverse yarns are monofilament yarns having non-circular cross sections with a plurality of lobes.

* * * * *